United States Patent [19]

Scott

[11] 4,220,811

[45] Sep. 2, 1980

[54] SCREW-ON ELECTRICAL CONNECTOR

[75] Inventor: William J. Scott, Sycamore, Ill.

[73] Assignee: Ideal Industries, Inc., Sycamore, Ill.

[21] Appl. No.: 936,587

[22] Filed: Aug. 24, 1978

[51] Int. Cl.[2] ..... H01R 5/12

[52] U.S. Cl. ..... 174/87; 339/67

[58] Field of Search ..... 174/87; 339/67

[56] References Cited

U.S. PATENT DOCUMENTS

| | | | |
|---|---|---|---|
| 3,156,761 | 11/1964 | Schinske | 174/87 |
| 3,297,816 | 1/1967 | Waddington | 174/87 |
| 3,448,223 | 6/1969 | Thorsman . | |
| 3,519,707 | 7/1970 | Krup . | |
| 3,676,574 | 7/1972 | Johansson . | |
| 3,875,324 | 4/1975 | Waddington . | |

*Primary Examiner*—Roy N. Envall, Jr.

*Attorney, Agent, or Firm*—Kinzer, Plyer, Dorn & McEachran

[57] ABSTRACT

This is a screw-on electrical connector of the type in which an insulating cap has a generally open central bore and a wire coil is positioned in the bore to engage the stripped ends of the wires. The interior of the bore is provided with a formation to engage the rear end of the coil for positioning and interlocking the two to provide the torque necessary to turn the connector down on the stripped ends of the wires. The forward portion of the bore is also provided with a dam structure or barrier to prevent the coil from coming out of the bore. The subject matter includes a method of making such a connector.

17 Claims, 5 Drawing Figures

SCREW-ON ELECTRICAL CONNECTOR

SUMMARY OF THE INVENTION

This is concerned with a screw-on electrical connector and more specifically is a connector of the so-called pigtail type in which an insulating cap has a generally open central bore with a wire coil in it so that the connector may be screwed down on the stripped ends of the wires.

A primary object of the invention is a connector of the above type in which the cap and coil are interlocked in an improved manner.

Another object is a connector of the above type in which the rear end of the coil is socketed to prevent the cap from ratcheting or turning on the coil when the connector is being screwed down on the stripped ends of a plurality of electric wires.

Another object is a joint for or between the coil and cap of a screw-on electrical connector which insures a tight fit or interlock for the smaller sizes of such connectors.

Another object is a connector with an improved form for holding the coil in the cap.

Other objects will appear from time to time in the ensuing specification and drawings.

DESCRIPTION OF THE PREFERRED EMBODIMENT

Figures 1, 3:
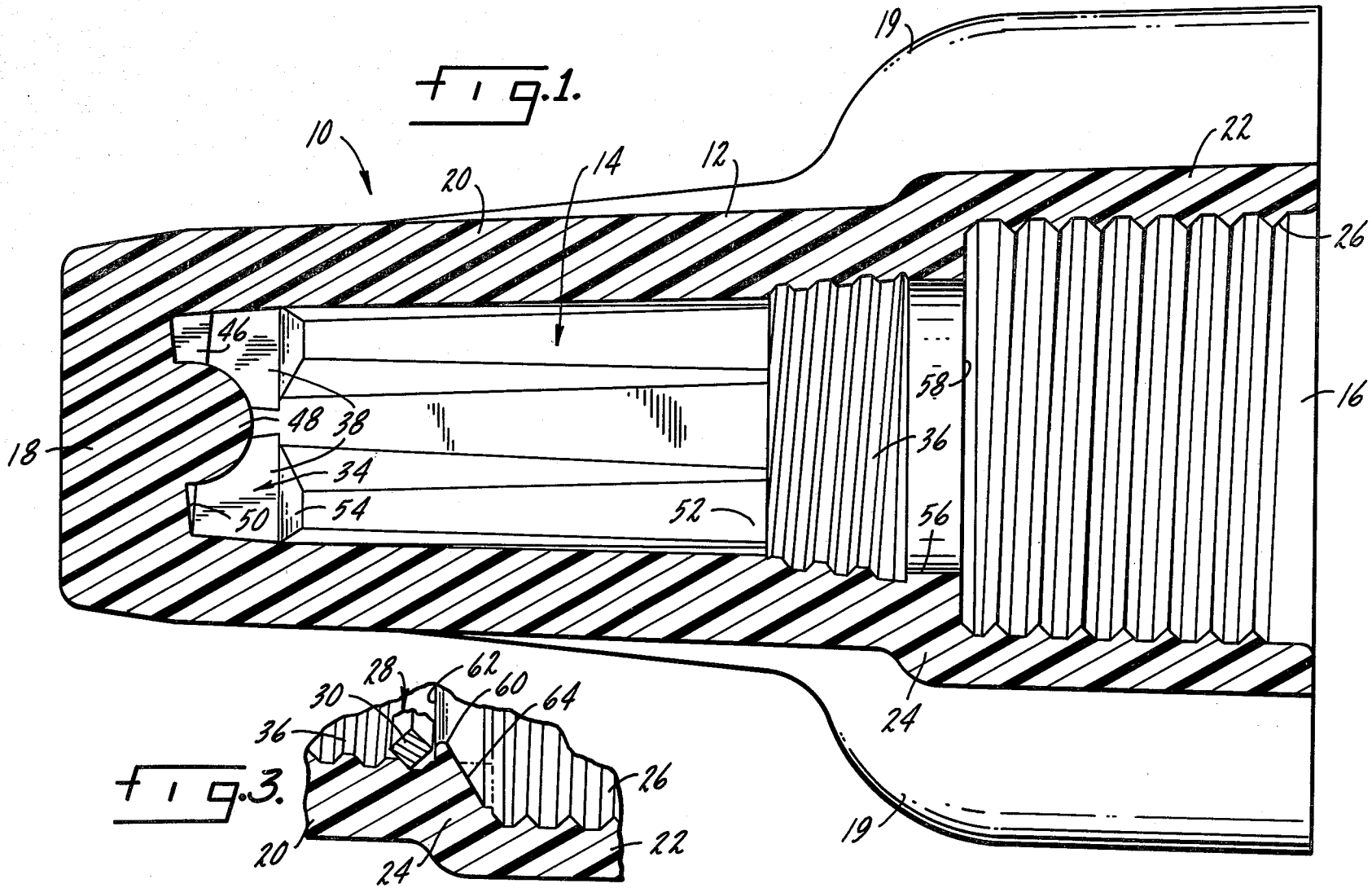
FIG. 1 is a section along line 1—1 of FIG. 4.
FIG. 3 is a portion of FIG. 1 in a different state of manufacture.
Figure 2:
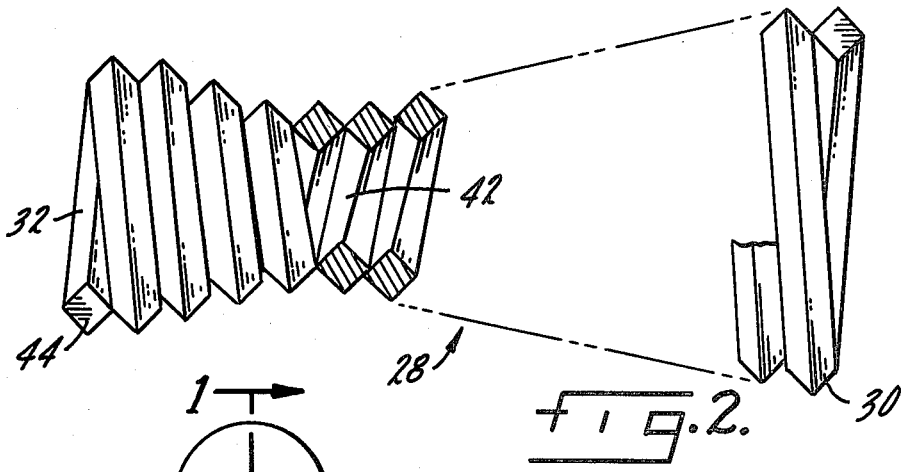
FIG. 2 is a side view, partly in section, of the coil on a reduced scale.

In FIGS. 1–3 a connector, indicated generally at 10, is shown which includes an outer shell or cap 12 made of an insulating material and having a generally open central bore 14 which is open at one end, as at 16, and closed at the other by an end wall 18. The exterior of the cap may have extensions of levers 19, if desired, to provide leverage so that the cap may be screwed down on the stripped ends of the wires. But the shape of the exterior is of no importance here.

The cap itself is divided into what may be considered a body portion 20 and a skirt portion 22 which merge or join at a junction 24, as set forth in detail hereinafter. The interior of the skirt may have a plurality of threads or a thread formation 26 which may be of any suitable shape and pitch and are intended primarily to engage the insulation on the exterior of the wires when the stripped ends have been pulled or forced or turned into the inner portion of the bore.

Figure 5:
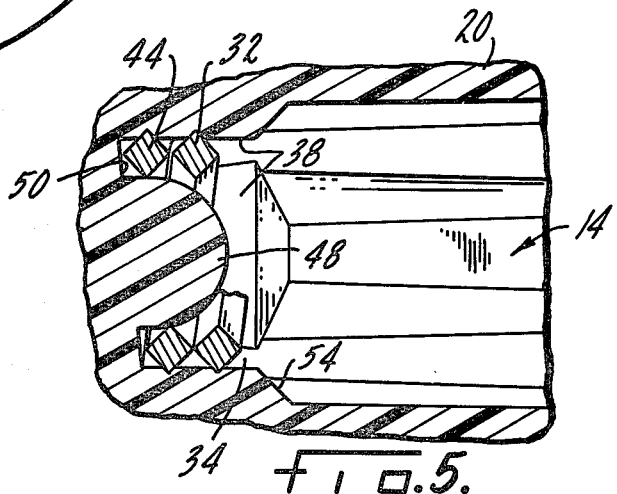
FIG. 5 is a portion of FIG. 1 in a different state of manufacture or assembly.

As shown in FIGS. 3 and 5, the inner portion of the bore houses or contains a wire coil or spring element 28, which may be considered to be generally tapered extending from a front end 30 and at the rear is generally enlarged as at 32 where it fits into a socket in the closed end of the bore, indicated generally at 34 in FIG. 1.

The enlarged front end engages or fits in a first area 36 formed in the bore which, as shown in FIG. 3, may be considered to be generally threaded with the pitch matching the pitch of the turns of the coil. It will be noted that the cross section of the wire of the coil is generally square and the threads in the first area 36 are truncated. There may be a degree of an interference fit between the two, which is to say that the coil, at its large end in its relaxed or free state will have an outside diameter somewhat greater than the root diameter of the threads in area 36 so that when the coil is turned into the bore a degree of compression or interference is acquired. This is to say that the coil will be compressed somewhat and, at the same time, the insulating material of the cap will be expanded or indented or deformed somewhat by the large end of the coil.

Figure 4:
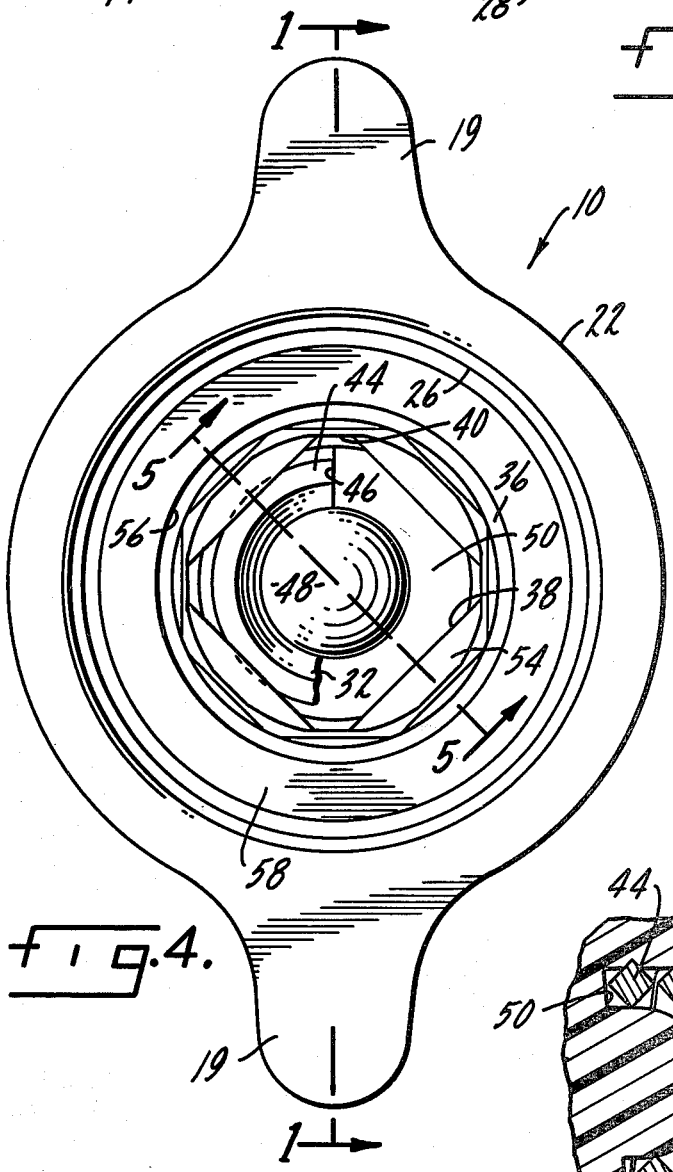
FIG. 4 is an end view, from the right end of FIG. 1.

The socket or small end 34 of the bore is formed as a square, as shown in FIG. 4, with four sides 38 which mesh with or are indented by the rear end 32 of the coil. As shown in FIGS. 4 and 5, the outside diameter of the coil at the inner end 32 will be somewhat greater than the side dimension of the square so that while the coil will clear the corners 40 of the square, it will indent or bite into the sides. Since the inner end 32 is tapered toward the minimum diameter or throat 42, only a certain number of the turns of the small end 32, for example two, will actually indent or engage the sides 38 of the square. The end of the wire, as at 44, engages a shoulder or wall 46 which will transmit the torque applied to the cap to the coil to drive it down or force it over the stripped ends of the wires. From the blunt end 44, the first full turn of the coil, working outwardly to the throat 42, will be in engagement with and probably will indent or deform the side surfaces 38 of the square. Thereafter, as shown in FIG. 5, additional turns may engage, but it is not essential. It is preferred that two full turns engage the flat side surfaces of the square, with the second turn being somewhat smaller in outside diameter than the first. But this is not essential.

The enlarged inner end 32 may also serve as a guide or pilot for the small end of the coil to center it relative to the axial bore of the cap during initial assembly.

The end wall of the cap may be provided with an enlarged, preferably integral, hemispherical projection, deflector or guide 48 on its inner surface. This projection may be aligned with the axis of the cap and may be of a diameter somewhat or materially smaller than the inner diameter of the cap bore. The projection may be a full hemisphere, or it may be slightly more or less. In any event, it is preferred that the effective diameter of the projection be such that an annular flat or wall or surface 50 is defined around the projection which may be on a helix terminating in the blunt surface 46.

The area between the forward threaded area 36 and the rear square area 34 may be considered to be somewhat transitional and is generally not in contact with the outer surface of the wire coil except, possibly, when the device has been applied to the stripped ends of the wires. As shown in FIG. 1, the intermediate area adjacent the forward area 36, as at 52, may be considered to be generally octagonal and the transition takes place back to inclines 54 at the square 34.

As shown in FIG. 1, the outer shell or cap is first formed or molded with a generally cylindrical area 56 between the coil-engaging threads 36 and the skirt 22 with a right angle or shoulder 58 thereon joining the insulation-engaging threads 26 and presenting an axial excess of material which may be coined or formed into a dam or barrier. It will be noted that the inside diameter of surface 56 is greater than the diameter of the small end 32 of the coil so that the axial excess presents no problem or difficulty in initially inserting the coil. The outside diameter of the large end 30 of the coil may but does not have to be slightly greater than the diameter of surface 56, but this is no problem because the interference is not enough to prevent the cap from being turned down on the coil during assembly, even though this may slightly indent or expand surface 56. With the coil fully seated in the position shown in FIG. 3, the axial excess 56–58 may be then coined over or upset by a heated die or the like to form an inwardly disposed barrier or dam 60. As shown, a generally upright wall 62 may be formed with an inside diameter that is substantially less than the outside diameter of the coil and, in fact, may be close to or less than the pitch diameter of the coil at its large end. The shape of the instrument forming or upsetting this material may be such that a diagonal surface 64 results which may be disposed at an angle of something on the order of 60° to the axis of the cap so that the entrance of the stripped ends of the wires is greatly facilitated by being funneled or channeled inwardly and will not hang up on or stick on the big end of the coil.

The use, operation and function of the invention are as follows:

It is conventional to provide an electrical connector which has an outer cap made of an insulating material and an inner wire coil with the two being interlocked so that the connector can be turned down on the stripped ends of two or more electric wires. The present subject matter is concerned with interlocking the cap and coil at the small end of the coil and particularly in the smaller sizes of connectors where it is difficult to mold an internal threaded surface with sufficient detail so that the coil and cap will accurately and fully interlock. The coil itself is of the so-called free spring type which means that it contacts the inner bore of the cap at its front and rear end and is out of contact in between prior to being used so that the coil, where it narrows down to the throat or minimum opening, is free to expand as the connector is turned down on the stripped ends of the wires which causes a shortening of the overall length of the coil which allows or causes the front end to walk back or unwind within its contact area, in this case shown as an outer threaded surface. The overall foreshortening of the coil, however, with the maximum combination of wires should not be such that the large front end normally comes out of contact or moves back of the forward threaded area, but it may under certain circumstances.

The rear end of the coil, meaning behind the throat, may have several turns expanded out to a somewhat larger diameter, but still smaller than the front end, which is to be interlocked into the rear of the cap bore which may be formed as a socket and, in the present case, is intended to be a square so that the turns of the coil, be it one or two, which engage in the socket, will indent the side walls in a deforming or swaging action but will not cut into the corners. As shown, at least one full turn engages the flat side walls of the square, but it might be more. Also, square wire has been used, but it might be round, teardrop shaped or otherwise.

When molding thread detail in small size connectors, the finished connector must be stripped or forced off of the molding pin and such threads are known as strip-molded threads. In the smaller sizes the stripping action may cause sufficient distortion of the threads with their crown and root flats and angle sides so that dilation and contraction can rapidly take place. Sufficient wall section over the threaded area helps in the undercut stripping. Where the thread diameter is small in relation to the thread depth, the insert or coil can form its own thread in assembly. The lead-in thread at the large end will help in assembly.

The coining operation in which the axial excess of material is deformed so that it presented a dam or barrier or undercut causes the insert to be partially or totally hidden. This undercut or dam is post formed, which may be done at room temperature with some plastics and others may require higher temperatures. This dam or undercut takes the form of a coined conductor guide and may be thought of as a concealor and retainer which would be approximately at the pitch diameter, or less, of the spring insert at its large open end.

In certain situations and/or with certain materials, the cap might be molded with the shoulder already formed similar to that shown in FIG. 3. Thereafter the coil or spring could be forced past the dam or shoulder, possibly followed by a touching up or slight coining or recoining of the dam or shoulder if it needed it, otherwise not.

One of the important aspects of the result of the coining or forming of the shoulder or undercut is that the cut end of the spring at the large end will be more or less hidden or shielded which will prevent one or more of the stripped ends of the wires from hanging up when they are inserted.

When the coil is screwed down on the wires, the stripped ends will eventually pass completely through the coil and will engage the end wall of the cap. The ends of the wires have normally been cut or snipped with electrician's pliers or the like and may be sharp or jagged. When the stripped ends contact the end wall of the cap, if the cap is thereafter turned an appreciable amount, the sharp ends of the wires may rip or drill through or otherwise mar the end wall. The projector or deflector in the end wall, within the square, is integrally formed with the end wall and is molded at the same time that the cap is molded. It does not have to be a precise hemisphere, but it should be shaped so that when the stripped ends of the wires hit its outer surface, the ends of the wires will be deflected or guided in an outward direction. Thereafter, additional turning of the cap will merely bend the wire ends into a helical or spiral configuration. And, in any event, they will not penetrate or damage the end wall. Additionally, the projection has the advantage that it will tend to center or guide or cause the rear end of the coil to be properly seated in the square socket and indent the side walls thereof, through one or two turns, since the projection will project into the interior of the small end of the coil.

The connector shell may be made of polycarbonate, polypropylene or the like.

While the preferred form and several variations of the invention have been shown, described and suggested, it should be understood that suitable additional modifications, changes, substitutions and alterations may be made without departing from the invention's fundamental theme.

I claim:

1. In an article of manufacture, a connector for joining the ends of two or more electric wires, including a cap of a stiffly flexible insulating material having a generally central bore open at one end and closed by an end wall at the other end, a generally tapered wire coil in the bore, the outer end of the coil being toward the open end of the cap and in engagement with an area on the inner surface of the central bore, the inner end of the coil being in engagement with a second area on the inner surface of the central bore adjacent the end wall, the second area having a polygonal cross section, thereby presenting a number of flat side surfaces to the inner end of the coil, at least one turn of the coil at the inner end engaging and indenting a plurality of the flat side surfaces, and means in the cap engaging the coil to prevent the coil from turning in the cap when the connector is turned down on the wires.

2. The structure of claim 1 further characterized in that the inner end of the coil has at least one expanded turn which contacts and indents the flat side surfaces.

3. The structure of claim 1 further characterized in that said last mentioned means includes an abutment in the cap engaging the end of the coil and prevents the coil from turning in the cap when the connector is screwed down on the wire.

4. The structure of claim 1 further characterized in that the area on the inner surface of the central bore engaged by the outer end of the coil has a thread formation thereon which generally matches the thread form of the outer end of the coil.

5. The structure of claim 1 further characterized in that the polygonal cross section in the second area is a square.

6. The structure of claim 1 further characterized by and including an integral enlarged skirt on the cap at the open end, and a plurality of integral outstanding ears on the skirt constructed and arranged to be manually grasped when the cap and coil are being turned down on the stripped ends of the wires.

7. The structure of claim 1 further characterized by and including a deflector in the bore at the end wall for preventing the wire ends from penetrating the end wall in the form of a symmetrical projection integrally formed on the inner surface of the end wall as an integral part thereof and projecting into the bore of the cap so as to lie at least partially within the confines of the polygonal cross section.

8. The structure of claim 1 further characterized by and including a coined over area in the central bore of the cap beyond and in engagement with the outer end of the coil and having an inside diameter that is less than the outside diameter of the outer end of the coil so that the coil cannot be withdrawn from the cap.

9. The structure of claim 1 further characterized in that the coil is made of wire having a square cross section.

10. The structure of claim 1 further characterized in that the inner surface of the central bore between the two areas has a generally octagonal cross section.

11. The structure of claim 1 further characterized in that the insulating material of the cap is polycarbonate.

12. The structure of claim 1 further characterized in that the coil in between the outer and inner ends is out of contact with the cap bore for a substantial distance.

13. The structure of claim 1 further characterized in that the area on the inner surface of the central bore engaged by the outer end of the coil has a thread formation, the threads thereof having flats of substantial axial extent both on the crests and roots.

14. The structure of claim 1 further characterized in that the area on the inner surface of the central bore engaged by the outer end of the coil has a thread formation thereon which generally matches the thread form of the outer end of the coil, the diameter of the turns of the coil at the outer end being substantially greater than the diameter of the thread formation on the inner surface of the central bore so that a substantial interference fit is provided.

15. The structure of claim 1 further characterized in that the polygonal cross-section in the second area is a square, each turn of the coil at the inner end engaging and indenting the flat side of the square being out of contact with the corners thereof.

16. The structure of claim 1 further characterized in that two turns of the coil at the inner end engage and indent the flat sides of the polygonal cross-section.

17. The structure of claim 1 further characterized by and including a dam in the central bore integrally formed therewith and disposed axially opposite the outer end of the coil to resist removal of the coil from the cap.

* * * * *